US005722248A

United States Patent [19]

Suh

[11] Patent Number: 5,722,248

[45] Date of Patent: Mar. 3, 1998

[54] OPERATING CONTROL CIRCUIT FOR A REFRIGERATOR HAVING HIGH EFFICIENCY MULTI-EVAPORATOR CYCLE (H.M. CYCLE)

[75] Inventor: Kook Jung Suh, Seoul, Rep. of Korea

[73] Assignee: Samsung Electronics Co., Ltd., Suwon, Rep. of Korea

[21] Appl. No.: 556,143

[22] Filed: Nov. 9, 1995

[30] Foreign Application Priority Data

| | | | |
|---|---|---|---|
| Nov. 11, 1994 | [KR] | Rep. of Korea | 94-29471 |
| Nov. 11, 1994 | [KR] | Rep. of Korea | 94-29474 |
| May 30, 1995 | [KR] | Rep. of Korea | 95-13927 |

[51] Int. Cl.[6] ..... F25D 17/06

[52] U.S. Cl. ..... 62/180; 62/229

[58] Field of Search ..... 62/180, 179, 186, 62/229, 442

[56] References Cited

U.S. PATENT DOCUMENTS

| | | | |
|---|---|---|---|
| 2,801,525 | 8/1957 | Bixler | 62/180 X |
| 3,107,502 | 10/1963 | Herndon, Jr. et al. | 62/180 |
| 3,218,819 | 11/1965 | Crotser | 62/442 X |
| 3,320,761 | 5/1967 | Gelbard | 62/180 |

*Primary Examiner*—Harry B. Tanner

*Attorney, Agent, or Firm*—Burns, Doane, Swecker & Mathis, L.L.P.

[57] ABSTRACT

A refrigerator includes a freezing compartment and a separate refrigerating compartment. A pair of evaporators is associated with the freezing and compartments, respectively. Each evaporator has a fan associated therewith. A compressor is connected to both of the evaporators. The compressors and fans are all electrically connected in parallel and operated simultaneously when the temperature in a selected one of the compartments is above a reference temperature. The selected compartment can be either the refrigerating compartment or the freezing compartment.

6 Claims, 6 Drawing Sheets

OPERATING CONTROL CIRCUIT FOR A REFRIGERATOR HAVING HIGH EFFICIENCY MULTI-EVAPORATOR CYCLE (H.M. CYCLE)

RELATED INVENTIONS

The present invention is related to inventions disclosed concurrently filed application Ser. Nos. 08/552,480 and 08/555,811 of the present inventor (attorney Docket Nos. 024012-171 and 024012-172, respectively).

BACKGROUND OF THE INVENTION

The invention is related to a refrigerator, and particularly, to an operating control circuit of a refrigerator and a method operating a refrigerator.

PRIOR ART

A conventional refrigerator comprises a freezing compartment and a refrigerating compartment which are cooled at different temperatures from each other. The refrigerator also includes the predetermined components for performing the refrigerating cycle to cool these compartments. The evaporator among these components is mounted in any one of these compartments to be heat-exchanged with air to be circulated. The blow fan is fixed adjacent to the evaporator to blow the heat-exchanged air into these compartments.

FIG. 1A schematically depicts the refrigerator 1 which is divided into a freezing compartment 2 and a refrigerating compartment 3. An evaporator 4 is installed in the rear wall of the freezing compartment 2, and a blow fan 5 is fixed over the evaporator 4. The refrigerator 1 is provided with an air flow passage 6 for guiding air heat-exchanged with the evaporator 4 into the compartments and an air flow passage 6' for introducing air circulated in the compartments back into the evaporator 4 for the heat-exchanging.

The refrigerating cycle of the refrigerator 1 includes a compressor 7 for compressing refrigerant to high temperature and pressure, a condenser 8 for condensing refrigerant with the heat-exchanging air around the periphery thereof, a capillary tube 9 for expanding the condensed refrigerant, and the evaporator, which are communicated in turn with one another by means of a refrigerant tube to form a closed circuit. Therefore, the refrigerant that is an operating fluid of the refrigerating cycle is compressed at the compressor 7, condensed at the condenser 8, expanded at the capillary tube 9 and then evaporated/heat-exchanged with air while passing through the evaporator 4 to absorb the heat from air in the compartments.

But, the refrigerators must control two temperature ranges different from each other,. using only one evaporator and one blow fan. In other words, the freezing compartment has to be maintained at the appropriate temperature, for example −21° C. to −15° C., for the freezing storage of foods. The refrigerating compartment also has to be maintained at the appropriate temperature, for example −1° C. to −6° C., for the refrigerating storage of foods. Due to this, a system control for cooling each compartment at the temperature to be required tends to be complicated, and also the configuration becomes complex. It not only makes the temperature control of each compartment difficult but also has a bad effect on the cooling performance of the evaporator. Consequently, the refrigerator has problems in not being able to cool quickly each of the refrigerating chamber and the freezing chamber to the predetermined temperature, and to promptly respond to the temperature changes of each compartment such as the load fluctuations or the temperature changes around the periphery of the refrigerator. In these respects, it has been required to minimize variations in the set temperature of each compartment. And it is very desirous to simplify the inner configuration of a refrigerator.

Thus, an object of the invention is to provide an operating control circuit and method for controlling the temperatures of freezing and refrigerating compartments, respectively.

Another object of the invention is to provide an operating control circuit and method for controlling the temperatures of the freezing and refrigerating compartments according to the temperature of either one of the compartments.

Another object of the invention is to provide an operating control circuit and method for facilitating the temperature control of each of the freezing and refrigerating compartments which are divided from each other.

SUMMARY OF THE INVENTION

According to the invention a refrigerator including a refrigerating cycle and an operating control circuit freezing and refrigerating compartments; first and second evaporators mounted on the freezing and refrigerating compartments, respectively; first and second blow fans mounted near over the blow fans in the freezing and refrigerating compartments, respectively, which are connected in parallel to an A.C. power source; a compressor mounted in the rear lower portion of the refrigerator, which is connected to the A.C. power source; a switch connected between the A.C. power source and the tap formed in front of the parallel coupled blow fans and for turning on/off the compressor and the first and second blow fans, simultaneously; a sensor for detecting the temperature of any one of the freezing and refrigerating compartments; and a control portion for controlling the operation of the switch to turn on/off the first and second blow fans, if the temperature detected by the temperature sensor is below the set temperature of any one of the freezing and refrigerating compartments, and to turn on the first and second blow fans, if the temperature detected by the temperature sensor is over the set temperature of any one of the freezing and refrigerating compartments.

Also, the control portion reads the temperature data every predetermined time from the temperature sensor provided in any one of the freezing and refrigerating compartments, compares the detected temperature with the temperature set by a temperature adjuster for users and controls the operation of the switch, thereby performing the operating control of a system.

BRIEF DESCRIPTION OF THE DRAWINGS

The invention now will be explained in detail with reference to the accompanying drawings, in which.

DETAILED DESCRIPTION OF PREFERRED EMBODIMENTS OF THE INVENTION

Figure 1A:
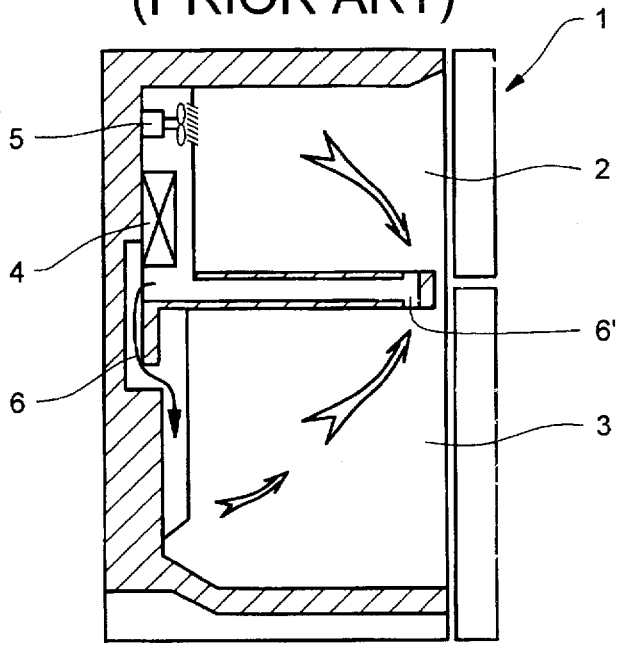
FIG. 1A (PRIOR ART)
FIG. 1A is schematic vertical cross-sectional view illustrating a conventional refrigerator.
Figure 1B:
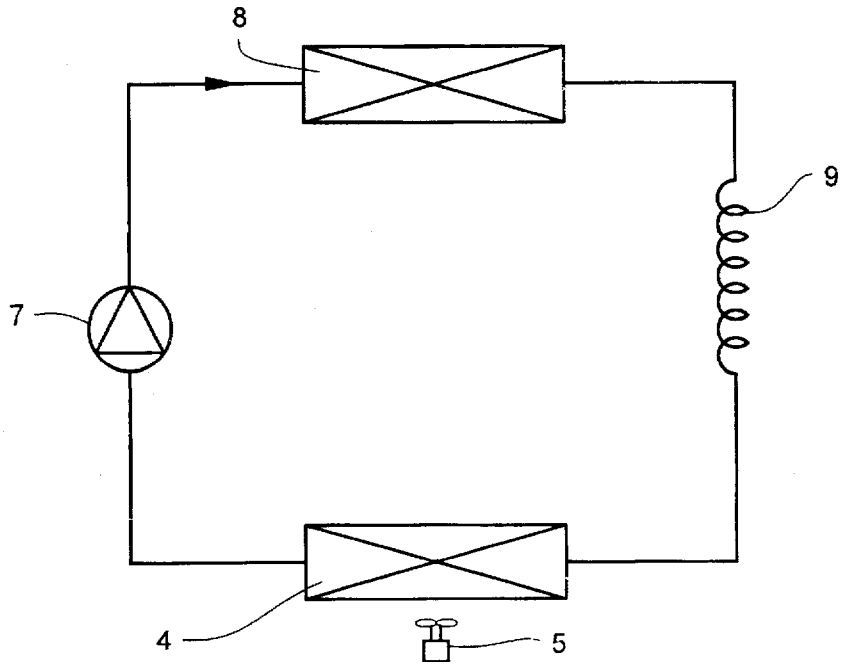
FIG. 1B (PRIOR ART)
FIG. 1B is a view illustrating a refrigerating cycle adapted to a conventional refrigerator.
Figure 2A:
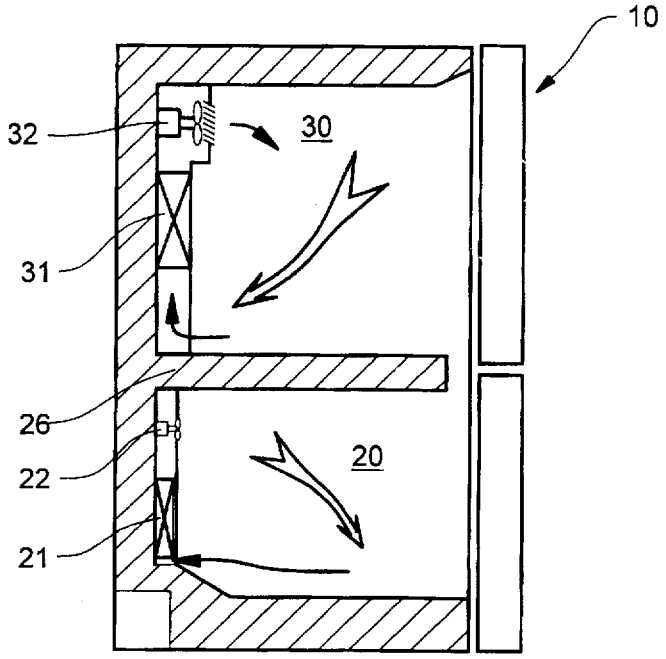
FIG. 2A is schematic vertical cross-sectional view illustrating a refrigerator according to the invention.
Figure 2B:
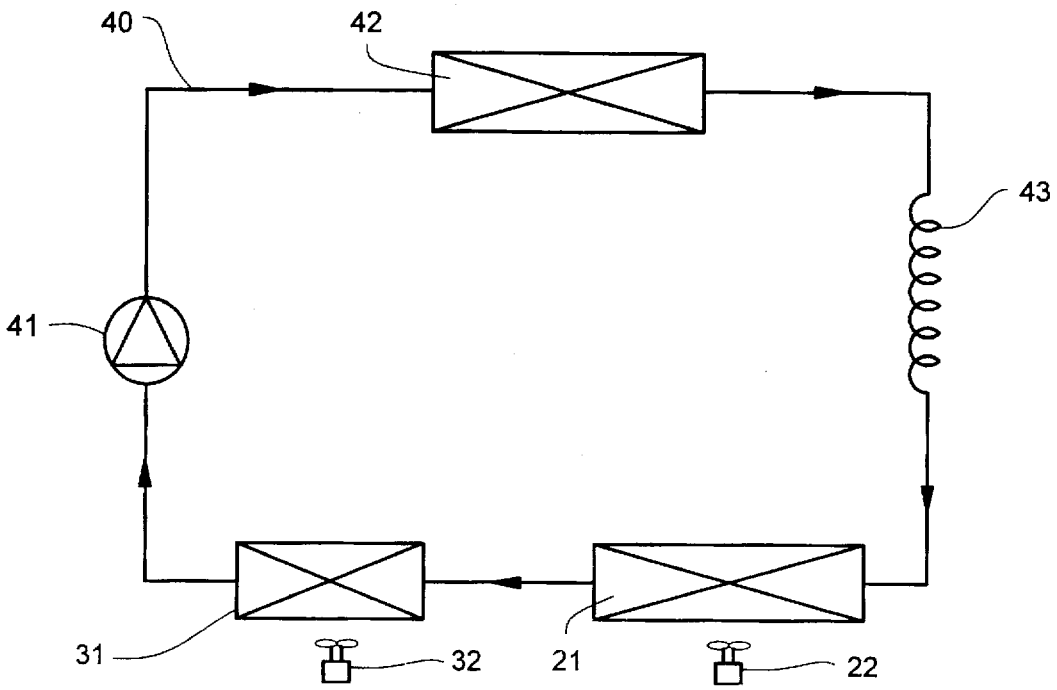
FIG. 2B is a view illustrating a refrigerating cycle adapted to the refrigerator according to the invention.

Referring to FIG. 2A, a refrigerator 10 comprises a freezing compartment 20 and a refrigerating compartment 30 which are divided from each other to prevent the mixing of cooled air in one another. A first evaporator 21 is mounted in the rear wall of the freezing compartment 20, and a second evaporator 31 is provided. in the rear wall of the refrigerating compartment 30. The first and second evaporators 21 and 31 are coupled in series with each other, which is included in a refrigerating cycle of FIG. 2B. The refrigerating cycle includes a compressor 41, a condenser 43, the first and second evaporators 21 and 31, a capillary tube 43 and refrigerant tube 40 to form a closed loop. Thus, the refrigerant is compressed at the compressor 41, condensed at the condenser 42 and then expanded at the capillary tube 43. The expanded refrigerant is partially evaporated in the first evaporator 21 and the remaining liquid is evaporated the second evaporator 31. The refrigerating cycle is repeated during the operating of the compressor 41. Herein, it is noted that the first and second evaporators 21 and 31 have their own inherent size and capacity which are designed to be matched with the volumes and control temperatures of the respective compartments being cooled.

On the other hand, a first blow fan 22 is mounted adjacent to the first evaporator 21, and a second blow fan 32 is mounted adjacent to the second evaporator 31. The first and second blow fans 22 and 32 are operated according to the operating of the compressor 41 to heat-exchange air flows circulated in each of the freezing and refrigerating compartments 21 and 31 with the first and second evaporators 21 and 31, respectively. At that time, the temperature of each compartment is controlled at the predetermined temperature. The first and second blow fans 22 and 32 are connected in parallel to each other over an A.C. power source.

Therefore, the invention does not require any additional structure except for a middle partition 26 as a result of the separation of the freezing and refrigerating compartments 21 and 31 from one another. In other words, no cooling air flow passage is required in the middle portion 26, and no duct and damper are required in the cooling air flow passages formed in the rear wall of the refrigerator. It means the configuration of a refrigerator is simplified.

Figure 3:
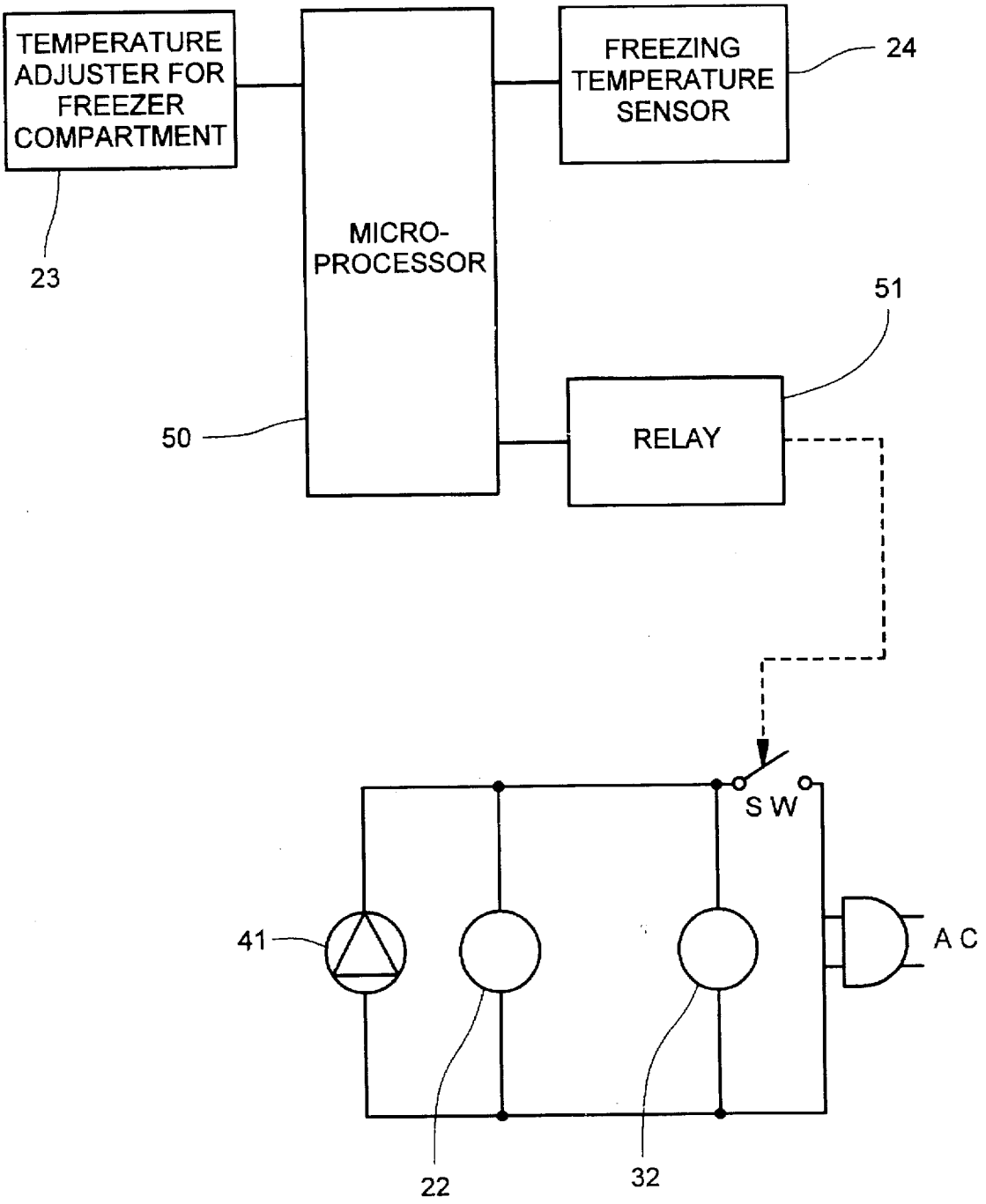
FIG. 3 is an operating control circuit according to one embodiment of the invention.

An operating control circuit for controlling the operation of a refrigerator according to one embodiment of the invention is shown in FIG. 3. The operating control circuit comprises a microprocessor 50, including a temperature adjuster 23 for setting the temperature of the freezing compartment 20 by users, and a temperature sensor 24 for detecting the temperature of the freezing compartment 20 connected to the microprocessor output portion; and a relay 51 connected to its outputting portion. The temperature adjuster 23 is provided on a control panel(not shown) of the refrigerator for setting the temperature of the freezing compartment 20 at the temperature appropriate to the freezing storage of foods. The setting range of the freezing storage temperature is −15° C. to 21° C. Generally, a user sets the temperatures of the freezing compartment 20 within the range. Actually, the set temperature of the freezing compartment 20 is selected to be any one of −21° C.(the strong freezing), −18° C.(the middle freezing) and −15° C.(the weak freezing). A switch SW is connected at one end to an A.C. power source AC which is turned on/off according to the operating of the relay 51. The other end of the switch SW is connected to one end of the compressor 41 and to the first and second blow fans 22 and 23 which are coupled in parallel to one another. The switch SW is positioned between the A.C. power source AC and the tap formed in front of the second blow fan 32. And the compressor 41 and the first and second blow fans 22 and 23 are connected in parallel to the A.C. power source AC.

Figure 4:
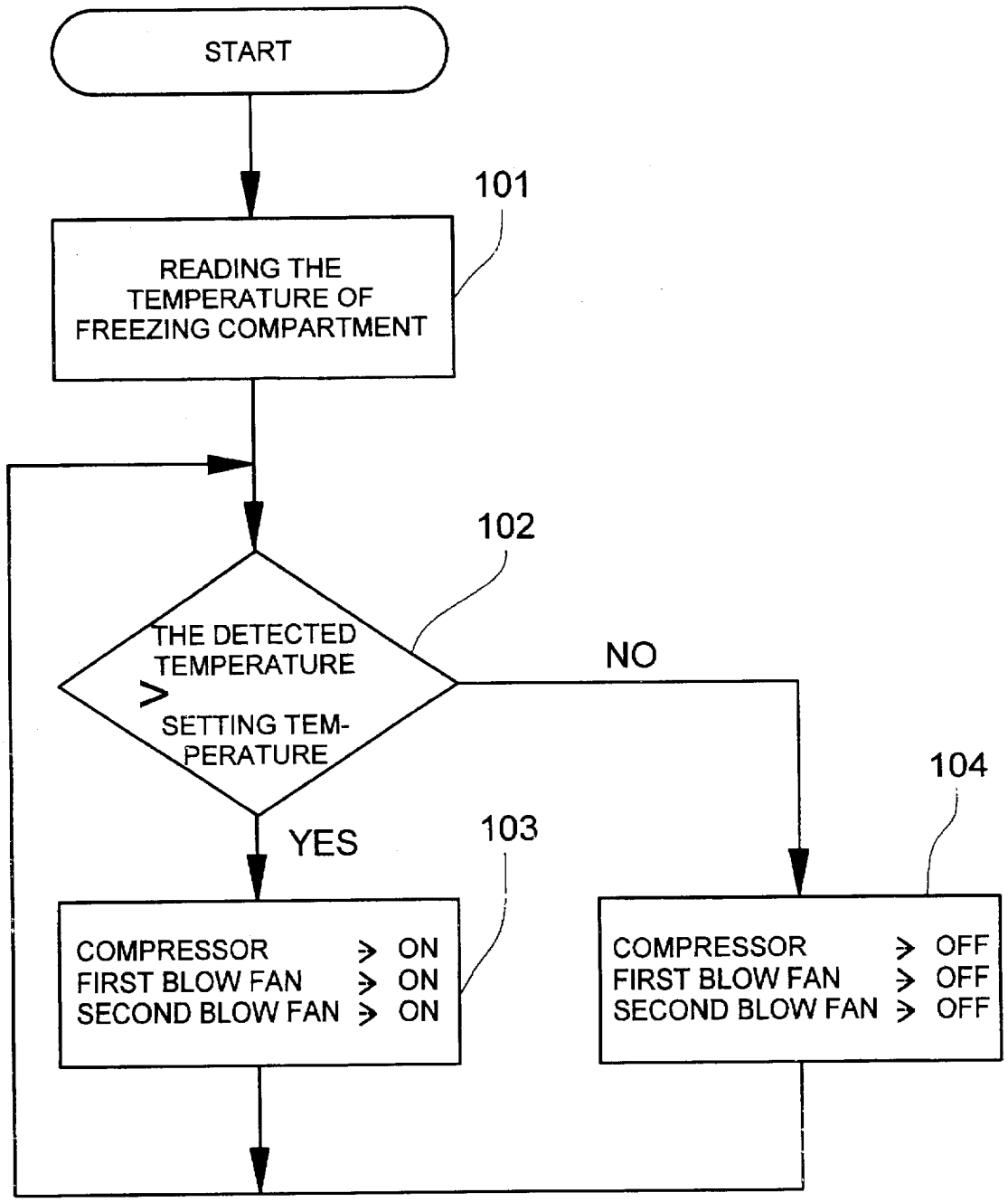
FIG. 4 is a flow chart illustrating the operation of the operating control circuit according to the embodiment of the invention depicted in FIG. 3.

According to one embodiment of the invention, as shown in FIG. 4, the microprocessor 50 controls an operating control circuit a reference value corresponding to the temperature of the freezing compartment as follows:

The microprocessor 50 reads the temperature data every predetermined time from the temperature sensor 24 provided in the freezing compartment 20 at step 101. In other words, the temperature of the freezing compartment 20 is detected by the temperature sensor 24 and then inputted to the microprocessor 50 to be checked. Step 101 goes onto step 102 to compare the detected temperature with the temperature set by the temperature adjuster 23. At that time, it is determined whether the detected temperature is greater than the set temperature. If the detected temperature is over the set temperature, control proceeds onto step 103 to operate the relay 51 for turning on the switch SW. Then, the compressor 41 and the first and second blow fans 22 and 32 are simultaneously operated. During the operating of the compressor 41 and the first and second blow fans 22 and 32 step 102 is repeated and, if the detected temperature falls below the set temperature, control proceeds onto step 104 to stop the relay 51 for turning off the switch SW. Then, the compressor 41 and the first and second blow fans 22 and 32 are simultaneously stopped.

Figure 5:
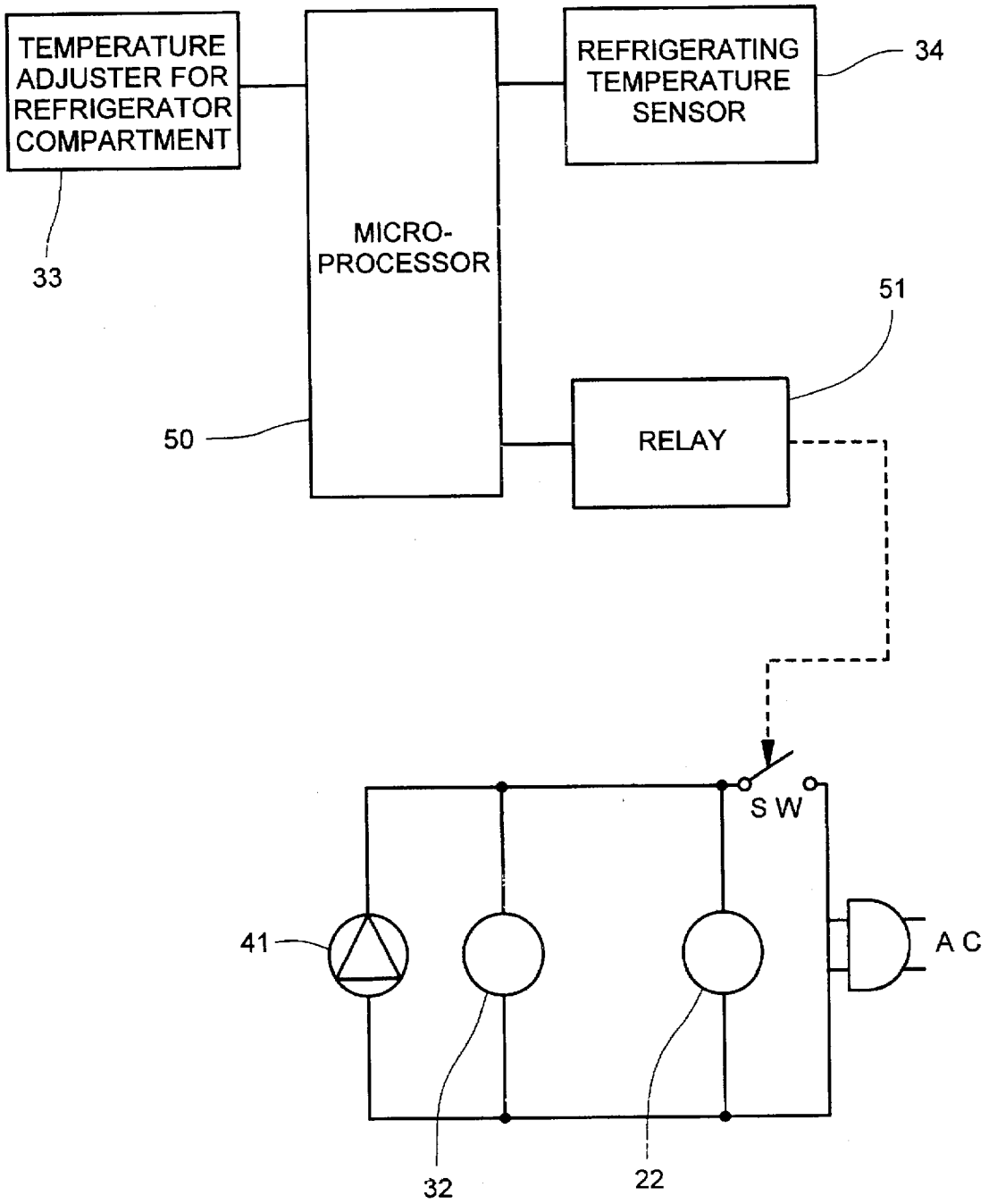
FIG. 5 is an operating control circuit according to another embodiment of the invention; and, FIG. 6 is a flow chart illustrating the operation of the operating control circuit according to the embodiment of the invention depicted in FIG. 5.
Figure 6:
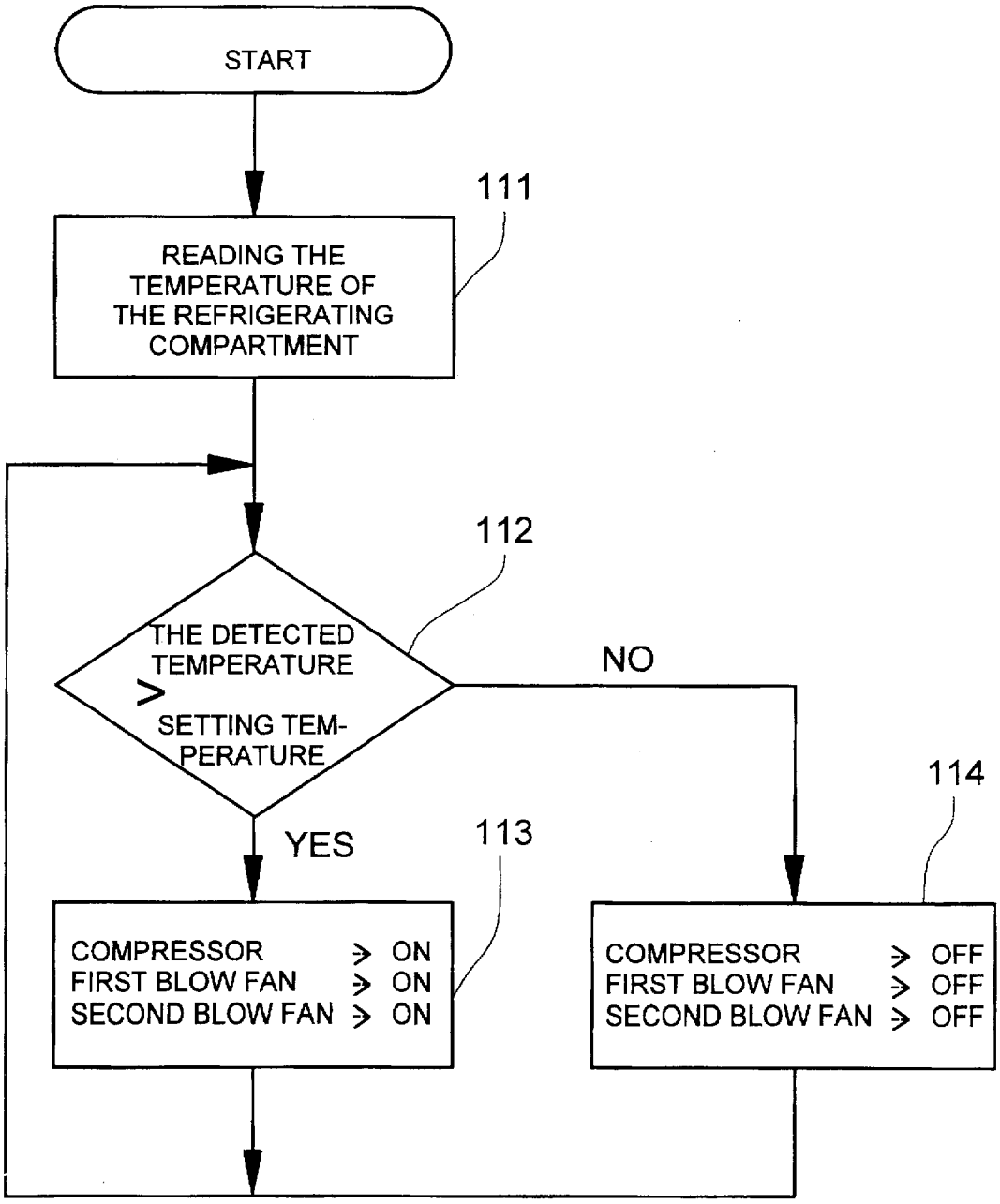

According to a second embodiment of the invention, as shown FIGS. 5 and 6, an operating circuit controls a system by a reference valve of the temperature value corresponding to the refrigerating compartment as follows:

The operating control circuit comprises a microprocessor 50 including a temperature adjuster 33 for setting the temperature of the refrigerating compartment 30 by users and a temperature sensor 34 for detecting the temperature of the refrigerating compartment 30 connected to a microprocessor inputting portion; and a relay 51 connected to a microprocessor outputting portion. The temperature adjuster 33 is provided on a control panel(not shown) of the refrigerator for setting the temperature for the refrigerating compartment 30 at the temperature appropriate to the refrigerating storage of foods. The setting range of the refrigerating storage temperature is −1° C. to −6° C. Generally, a user sets the temperatures of the refrigerating compartment 30 within the range. Actually, the set temperature of the refrigerating compartment 30 is selected to be any one of −1° C.(the strong refrigerating), −3° C.(the middle refrigerating) and −6° C. (the weak refrigerating). A switch SW is connected at one end to an A.C. power source AC, which is turned on/off according to the operating of the relay 51. The other end of switch SW is connected to the one end of the compressor 41 and to the first and second blow fans 22 and 23 which are coupled in parallel to one another. The switch SW is positioned between the A.C. power source AC and the tap formed in front of the second blow fan 32. And the compressor 41 and the first and second blow fans 22 and 23 are connected in parallel to the A.C. power source AC.

According to second embodiment of the invention, the microprocessor 50 reads the temperature data every predetermined time from the temperature sensor 34 provided in the refrigerating compartment 30 at step 111. In other words, the temperature of the refrigerating compartment 30 is detected by the temperature sensor 34 and then inputted to the microprocessor 50 to be checked. Step 111 goes onto step 112 to compare the detected temperature with the temperature set by the temperature adjuster 33. At that time, it is determined whether the detected temperature is greater than the set temperature. If the detected temperature is over the set temperature, control proceeds onto step 113 to operate the relay 51 for turning on the switch SW. Then, the compressor 41 and the first and second blow fans 22 and 32 are simultaneously operated. During the operating of the compressor 41 and the first and second blow fans 22 and 32, step 112 is repeated and if the detected temperature falls below the set temperature at step 112, control proceeds on step 114 to stop the relay 51 for turning off the switch SW. Then, the compressor 41 and the first and second blow fans 22 and 32 are simultaneously stopped.

As described above, the invention can operate a compressor and first and second blow fans, simultaneously, thereby cooling both of the freezing and refrigerating compartments, quickly. Also, the invention results in a simple structure of a refrigerator thanks to the elimination of an air flow passage and also results in a simple operating control circuit thanks to the use of the temperature detected by one sensor provided in either of the freezing and refrigerating compartments.

What is claimed is:

1. A refrigerator comprising:

at least two separate cooling compartments operating at different temperatures;

evaporators communicating with respective cooling compartments;

first and second fans communicating with respective evaporators and connected in parallel to an air conditioning power source;

a compressor for compressing refrigerant supplied to the first and second evaporators, the compressor connected in parallel to the first and second fans and to an electrical power source;

a single switch for controlling the application of electrical power to the compressor and the first and second fans;

a temperature adjuster for setting a temperature of one of the cooling compartments;

a sensor for detecting a temperature of the one cooling compartment; and a controller for controlling the switch in response to a temperature detected by the sensor to simultaneously turn on or off the compressor and the first and second fans.

2. The refrigerator according to claim 1 wherein the cooling compartments comprise a freezing compartment and a refrigerating compartment, the temperature adjuster sets a temperature of the refrigerating compartment, and the sensor detects a temperature of the refrigerating compartment.

3. The refrigerator according to claim 1 wherein the cooling compartments comprise a freezing compartment and a refrigerating compartment, the temperature adjuster sets a temperature of the freezing compartment, and the sensor detects a temperature of the freezing compartment.

4. A method of controlling the operation of a refrigerator, the refrigerator including at least two separate cooling compartments operating at different respective temperatures; evaporators communicating with respective ones of the cooling compartments; first and second fans communicating with respective evaporators and connected in parallel to a power source; a compressor connected in parallel to the fans and the power source; and a single switch for controlling the application of power to the compressor and the first and second fans; the method comprising the steps of:

A. periodically detecting a temperature of one of the cooling compartments;

B. comparing the detected temperature with a reference temperature; and

C. controlling the operation of the switch in response to step B to simultaneously turn on or off the compressor and the first and second fans.

5. The method according to claim 4 wherein the cooling compartments comprise a freezing compartment and a refrigerating compartment, step A comprises detecting a temperature of the refrigerating compartment; step B comprising comparing the detected temperature with a reference temperature of the refrigerating compartment; and step C comprising turning on the compressor and first and second fans when the detected temperature of the refrigerating compartment is above the reference temperature, and turning off the compressor and fans when the detected temperature is below the reference temperature.

6. The method according to claim 4 wherein the cooling compartments comprise a freezing compartment and a refrigerating compartment, step A comprises detecting a temperature of the freezing compartment; step B comprising comparing the detected temperature with a reference temperature of the freezing compartment; and step C comprising turning on the compressor and fans when the detected temperature of the freezing compartment is above the reference temperature, and turning off the compressor and fans when the detected temperature is below the reference temperature.

* * * * *